United States Patent [19]

Bourgeois

[11] 4,191,223

[45] Mar. 4, 1980

[54] POWDER TRANSFER SYSTEM

[76] Inventor: Leonard Bourgeois, 341 St. Marc St., Chateauguay, Quebec, Canada, J6J 2K2

[21] Appl. No.: 897,485

[22] Filed: Apr. 18, 1978

[51] Int. Cl.[2] ..... B65B 1/04

[52] U.S. Cl. ..... 141/18; 141/67; 141/286; 141/311 R; 141/392

[58] Field of Search ..... 141/1–12, 141/18, 44, 45, 46, 47, 49, 50, 54–61, 67, 68, 99, 285, 286, 392, 311 R

[56] References Cited

U.S. PATENT DOCUMENTS

| | | | |
|---|---|---|---|
| 3,875,980 | 4/1975 | Getz | 141/311 |
| 4,083,607 | 4/1978 | Mott | 141/67 |

FOREIGN PATENT DOCUMENTS

| | | | |
|---|---|---|---|
| 614268 | 2/1961 | Canada | 141/18 |

*Primary Examiner*—Houston S. Bell, Jr.
*Attorney, Agent, or Firm*—Romney, Schaap, Colant, Disner & Ashen

[57] ABSTRACT

The present invention provides an apparatus suitable for transferring powdered material and particularly suitable for filling fire extinguishers of the dry chemical type. The apparatus includes a reservoir for storing the powder and a vacuum system for transferring the powder to a filling nozzle. The apparatus also includes means for filling the reservoir from conventional shipping containers and preferably includes filters and cut-off means automatically operable to shut off the apparatus when the transfer of powder is complete.

13 Claims, 9 Drawing Figures

POWDER TRANSFER SYSTEM

The present invention relates to a transfer system and more particularly, relates to an apparatus suitable for transferring a fluid from one container to a further container by means of a vacuum system.

The present invention is particularly applicable to a transfer system suitable for the transfer of powdered fire-retardant material such as is used in dry chemical fire extinguishers. Thus, although many different types of fire extinguishers are employed, one of the most widely accepted types is the dry chemical cylindrical extinguisher. Such extinguishers find universal use both in the home and industry. However, after use, recharging of the extinguisher with fresh chemicals is required and as well, it is recommended that such extinguishers be recharged periodically even without undergoing use.

Generally, to date, the recharging techniques which have been developed for recharging fire extinguishers have not been as efficient as might otherwise be desired—for example, manual filling of the container is still widely practised. Proposals for automation have been made—see U.S. Pat. No. 3,875,980 issued Apr. 8, 1975, to Getz. However, the system illustrated in Getz does not fill many requirements, such as shutting off once the extinguisher has been filled and still further, for an integral transfer system for transferring powder to the central reservoir.

It is an object of the present invention to provide a system and apparatus which is suitable for transferring fluids, and in particular a powder, from a central container or reservoir to a further container such as a fire extinguisher.

It is a further object of the present invention to provide an apparatus suitable for filling and refilling fire extinguishers of the dry chemical powder type wherein the apparatus automatically fills the extinguisher with the desired amount and subsequently automatically shuts off.

It is a further object of the present invention to provide an apparatus and system suitable for filling fire extinguishers wherein the powdered fire-retardant material may be transferred from an external open or closed container to an integral reservoir of the apparatus wherein it is stored for subsequent use, the transfer of the powder being accomplished by means of a vacuum system.

Other objects and advantages of the apparatus and system according to the present invention will become apparent from the following description thereof.

According to one aspect of the present invention, there is provided an apparatus for transferring powder. The apparatus includes a reservoir adapted to contain powdered material and an outlet conduit which is in fluid communication with a lower portion of the reservoir. A filling nozzle is associated with the other end of the outlet conduit and there are provided means for connecting a vacuum source to a filling assembly which includes the filling nozzle such that a vacuum applied thereto will cause powder to flow from the reservoir through the outlet conduit to the filling nozzle. The vacuum source is also operatively connected to an upper portion of the reservoir.

In a further aspect of the present invention, there is provided a powder transfer apparatus which is adapted to transfer powder from a reservoir to a container, the apparatus comprising a reservoir, an outlet conduit having one end thereof in fluid communication with a lower portion of said reservoir, a vacuum source, a filling assembly including a filling nozzle connected to the other end of said outlet conduit, conduit means extending between said vacuum source and said filling assembly such that when a vacuum is applied, a powder in said reservoir will flow through said outlet conduit to said filling nozzle, and vacuum sensing means situated in said conduit means, said vacuum sensing means being associated with means to shut off said vacuum source when the vacuum in said conduit means exceeds a predetermined value.

According to a further aspect of the present invention, there is provided a powder transfer system including a reservoir, an outlet conduit having one end thereof in fluid communication with a lower portion of said reservoir, a vacuum source, a filling assembly including a filling nozzle connected to the other end of said outlet conduit, conduit means extending between said vacuum source and said filling assembly and operative to cause a powder to flow through said outlet conduit when a vacuum is applied, refill means for filling said reservoir from an external container, said refill means including an inlet conduit situated in an upper portion of said reservoir, and filter means in said conduit means between said vacuum source and said filling assembly, said filter means including a discharge conduit extending from the filter to said reservoir such that any powder retained by said filter means may be recycled back to the reservoir.

In greater detail, the reservoir, which is adapted to receive and retain the powder later to be employed in filling a container such as a fire extinguisher, may be of any desirable configuration. In the preferred embodiment, the outlet is located at the bottom thereof and in order to reduce powder "hang-ups", the reservoir may include a conical bottom portion. The reservoir may be manufactured of any suitable material and is a closed container. In this respect, a suitable cover means or the like may be employed. For most efficient operation, the cover should mate with the body portion so as to provide a substantially airtight connection for reasons which will become apparent hereinafter.

An outlet conduit through which the powdered material in the reservoir flows is connected to the reservoir, preferably at the bottom point thereof. At the outlet, and in order to aid in the flow of the powder, an optional fluidizer may conveniently be provided. Such fluidizers are known in the art and many different types may be employed.

The outlet conduit from the reservoir is connected to a filling assembly. This filling assembly is adapted to cooperate with the container or extinguisher to be filled. The filling assembly includes a "nozzle" connected to the conduit from the central reservoir. In this respect, the nozzle may be of any convenient type and indeed, may simply be a continuation of the conduit. Means are provided to seal the opening through which the container is to be filled and this may conveniently be accomplished by any suitable plug or the like which is adapted to receive the filling nozzle. The filling assembly also includes means for applying a suction force to the container such that a differential in pressure between the interior of the container and the reservoir will cause a flow of powder from the reservoir to the container to commence and continue.

In a preferred embodiment of the present invention, the filling assembly includes the above-mentioned sealing means, an "adjustable" nozzle and the means for applying the vacuum, all in one convenient unit. Thus, the filling nozzle may consist of a continuation of the outlet conduit from the reservoir with a "skirt" or outer tube around a portion thereof. The outer tube or skirt defines a chamber between itself and the outlet conduit; a vacuum line from a suitable vacuum source is connected in operative relationship thereto. A sealing plug extends about the outer end of the skirt and preferably, under most conditions the conduit extends substantially below the chamber formed by the skirt. Thus, the conduit, when in an operative relationship with the container to be filled, extends a substantial distance downwardly into the container. The vacuum is withdrawn at the very upper portion of the container thus minimizing the flow of any of the particulate matter through the vacuum line. The sealing plug is preferably of a resilient material such that, as the vacuum is applied, the seal is maintained. In a preferred embodiment of the invention, the axial relationship of the skirt and nozzle are adjustable with respect to each other—i.e. the distance separating the terminating ends of the skirt and nozzle is variable. This may be accomplished by many different mechanical expedients known to those skilled in the art.

The vacuum source may be any suitable and known to those skilled in the art. Thus, there may be provided a suitable pump with or without the use of vacuum filling tanks, valve assemblies, and the like.

The apparatus also includes, in the preferred aspects thereof, means for applying suction or a vacuum to the reservoir. Conveniently, this is accomplished using the same vacuum source as employed for the filling assembly. Thus, a second conduit may lead from the vacuum source or, alternatively, a switching valve connected to the vacuum source, to the central reservoir. Preferably, the vacuum is applied to the reservoir near an upper portion thereof and more preferably, at the top of the reservoir, again for reasons which will become apparent hereinafter.

The apparatus, as aforementioned, preferably includes means for refilling the reservoir from an external tank or container. To this end, the apparatus may include a refill assembly for use, for example, with a bulk container. The refill assembly includes a conduit through which the fluid is adapted to flow from the external container to the reservoir, with the conduit being connected to an appropriate inlet to the reservoir. This inlet is preferably located in a side wall of the reservoir proximate the top portion thereof and is adapted to impart to the powder flowing therethrough, a vortical flow. To this end, the inlet is preferably directed tangentially to the cylindrical wall of the reservoir. Surrounding the conduit, at the inlet end thereof, is an outer tube or skirt thus forming a chamber between the inner conduit and outer skirt. The skirt terminates short of the termination of the inner conduit and is provided with one or more apertures communicating with the chamber, the apertures preferably being located in the upper portion of the tube or skirt. Optionally, the refill assembly may include a strainer mesh or the like at the inlet end thereof. By incorporating such a mesh in the refill assembly, it will function to only permit a desired powder to flow therethrough. Preferably, the strainer mesh is replaceable and thus may easily be changed according to the powdered material desired.

The apparatus, according to the present invention, also preferably includes means for receiving discharged material from a dry chemical fire extinguisher. To this end, the apparatus may include a universal adapter to fit the nozzle of the fire extinguisher, which nozzle is connected to a conduit leading to the central reservoir. Conveniently, the conduit may be common with the refill assembly conduit.

As will be appreciated by those skilled in the art, despite the specific arrangement for the vacuum discussed above, some powder material may still enter the vaccum lines, either when refilling the reservoir or alternatively, when discharging the reservoir to the extinguisher. In order to prevent any stray powder from entering the suction pump or like suction-producing device, filter means are desirably provided. In the preferred embodiment of the invention, dual filter means are provided—a first one in association with the vacuum conduit running to the filling assembly and a second one in conjunction with the vacuum line for the refill assembly.

As previously mentioned, the apparatus or system also preferably includes means permitting the automatic cut-off of the system when the extinguisher is filled or when there is a malfunction. According to this aspect of the invention, there is provided a vacuum-sensing switch in the vacuum line operative to shut off the vacuum source when the vacuum reaches a predetermined level. Thus, when the vacuum pump is operative to withdraw air from an empty extinguisher, a rise in the vacuum will occur as the extinguisher becomes filled. The pressure-sensing device, in conjunction with a suitable microswitch, could then operate to shut off the vacuum source. Such pressure-sensing switches and associated microswitches are well known to those skilled in the art and readily available on the market. In conjunction with this, the vacuum line on which the sensing device is mounted may include an adjustable "bleed" valve. This valve would be open to atmospheric air to permit the introduction thereof into the vacuum line and thereby control the amount of vacuum drawn. By so doing, the function of the sensing device can also be affected and controlled. This permits the operator of the device to control the operation of the cut-off means without actually adjusting the same and changing the setting.

Having thus generally described the invention, reference will be made to the accompanying drawings illustrating an embodiment of an apparatus adapted to fill fire extinguishers with a powder material, in which.

Figure 1:
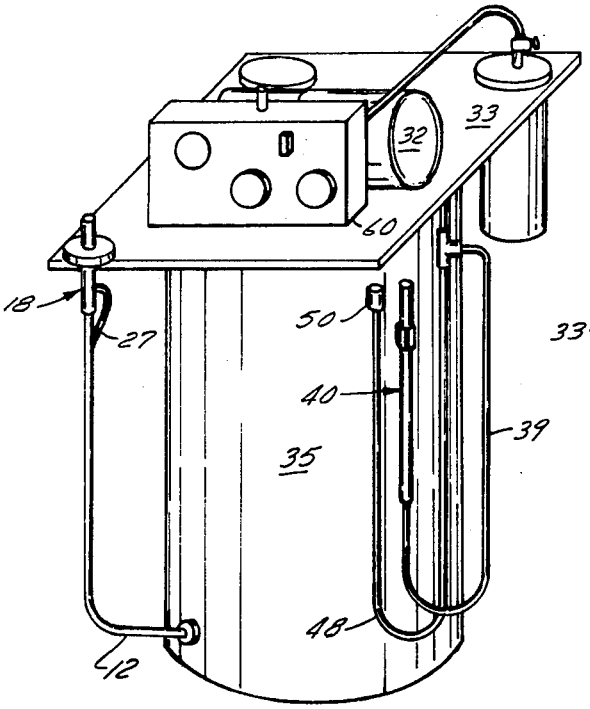
FIG. 1 is a perspective view of an embodiment of the apparatus.
Figure 2:
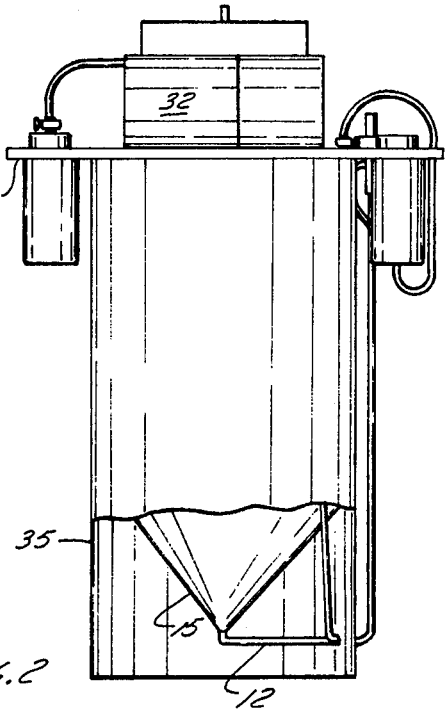
FIG. 2 is a side elevational view, partially cut away, of the apparatus of FIG. 1.

Referring to the drawings in greater detail, the apparatus includes a central reservoir generally designated by reference numeral 10 and which reservoir is adapted to receive and contain powdered fire-retardant materials.

Central reservoir 10 is comprised of an upper cylinder portion 11 and a lower conical portion 15. Situated at the base of conical portion 15 is fluidizing device 14. Fluidizer 14 is in the form of a deflector which imparts a "swirl" pattern to the powder at the cone apex, thus eliminating clogging and powder hang-up at this point.

Figure 4:
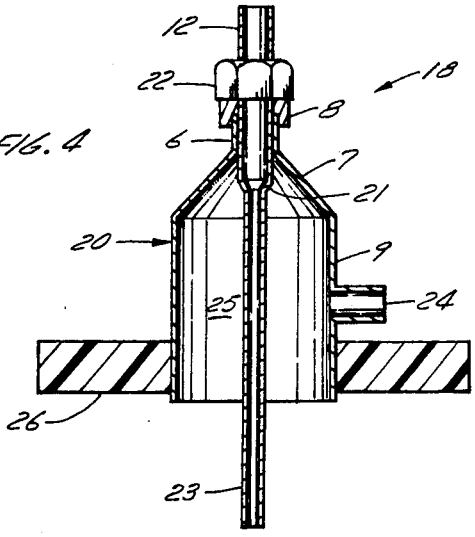
FIG. 4 is a cross-sectional view of the filling assembly.

A conduit 12 extends from the outlet at the bottom of conical portion 15 to a filling assembly which is generally designated by reference numeral 18 and is illustrated in greater detail in FIG. 4 which will now be referred to.

Filling assembly 18 includes a continuation of conduit 12 which is necked-down at point 21 to produce a narrower diameter nozzle 23. Surrounding nozzle 23 is an outer skirt indicated generally by reference numeral 20 and which includes a neck portion 6 sized to snuggly fit over conduit 12, an outwardly tapering portion 7, and a downwardly extending cylindrical portion 9. Cylindrical section 9 defines a substantially annular chamber 25 about nozzle 23. It will be noted that skirt 20 is held in a desired position by means of a lock-nut 22 and associated bushing 8 adapted to engage section 6. With this arrangement, the axial position of skirt 20 with respect to nozzle 23 is adjustable. Extending through section 9 and thus in fluid communication with chamber 25 is an outlet port 24. Extending about the bottom portion of skirt 20 is a sealing disc 26 which is of a resilient material such as, for example, rubber.

Attached to outlet port 24 is a vacuum conduit 27 as best seen in FIGS. 5 through 8. Vacuum conduit 27 extends to an outlet side of a switching valve 28. The inlet side of switching valve 28 is connected to a vacuum source generally designated by reference numeral 30. In the illustrated embodiment, vacuum source 30 comprises a vacuum pump 32 mounted on a suitable plate member 33 which in turn seats on top of an exterior shell 35 surrounding reservoir 10.

Also extending from the outlet side of valve 28 is a further vacuum line 34. Vacuum line 34 extends interiorly of central reservoir 10 for a short distance wherein it terminates.

Figure 3:
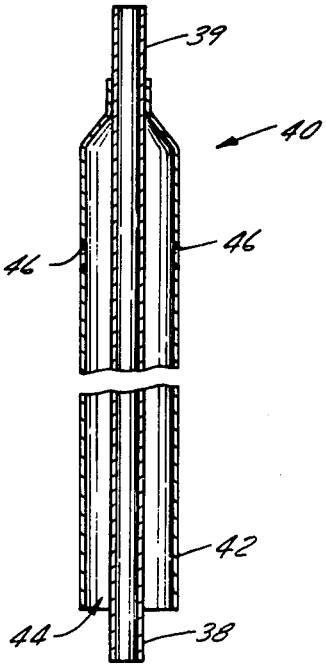
FIG. 3 is a cross-sectional view of the refill assembly.

The illustrated apparatus also includes a refill assembly 40 which is illustrated in FIG. 3. Refill assembly 40 includes a refill nozzle 38 which is surrounded by an outer skirt or tube 42 thus forming an annular space 44. Nozzle 38, as may be seen in FIG. 3, extends downwardly a distance slightly greater than the end of skirt 42. Skirt 42 is provided with, in its upper portions, a plurality of apertures 46.

Nozzle 38 is contiguous with a condiut 39 which is in communication with the interior of reservoir 10 by means of an inlet generally designated by reference numeral 36. Inlet 36 is located in the upper cylindrical portion of reservoir 10 and preferably is tangentially directed with respect to the side walls of the reservoir.

The apparatus also includes, connected to conduit 39 and in fluid communication therewith, a further conduit 48 terminating in an adapter 50, which is adapted to fit on the nozzle of a fire extinguisher.

The apparatus includes a control panel generally designated by reference numeral 60 which control panel may contain suitable vacuum gauges and control knobs for operation of the apparatus.

Figure 6:
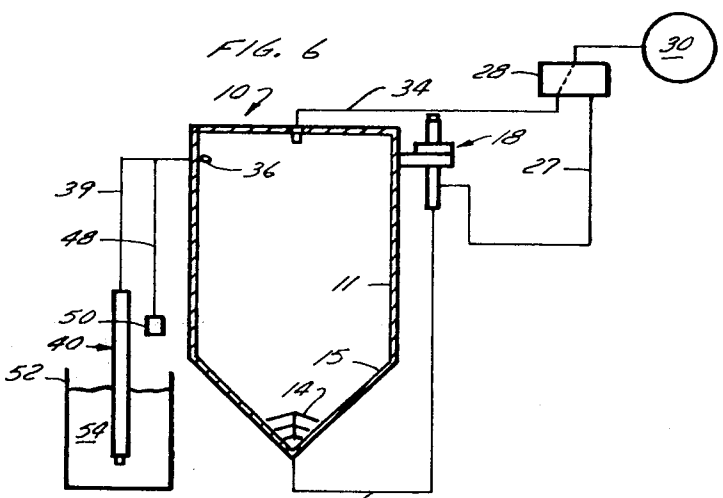
FIG. 6 is a schematic sectional view of the apparatus when employed to fill the central reservoir.

Referring to FIGS. 5 through 8 in respect of the functioning of the apparatus, and in particular to FIG. 6 illustrating the filling of the central reservoir from an external container 52 containing powder fire retardant material 54, it will be seen that valve 28 is switched to connect vacuum source 30 to conduit 34 such that a vacuum is applied to the interior of reservoir 10. At the same time, assembly 40 and and in particular nozzle 38, is placed in powdered material 54. In this respect, the powder 54 may or may not be open to atmospheric pressure. As will be seen, the application of a vacuum to central reservoir 10 will induce a vacuum within conduit 39; it is understood that conduit 48 is sealed. As the result of the above, atmospheric air will be drawn through apertures 46 within skirt 42 and flow downwardly through chamber 44 causing a local fluidization of the powder in the vicinity of the tip of nozzle 38. Thereafter, the fluidized powder will be transported through conduit 38 to inlet 36 and this flow will be maintained until all the powder in container 52 is transferred to reservoir 10 provided that the pressure differential between the interior fo reservoir 10 and atmospheric pressure is maintained.

As previously mentioned, inlet 36 is tangentially directed with respect to the cylindrical walls of the upper portion 11 of reservoir 10. Thus, the powder flowing through inlet 36 will assume a generally vortical configuration about the wall until it falls to the bottom of the reservoir, thereby minimizing any powder flowing through vacuum line 34.

Figure 7:
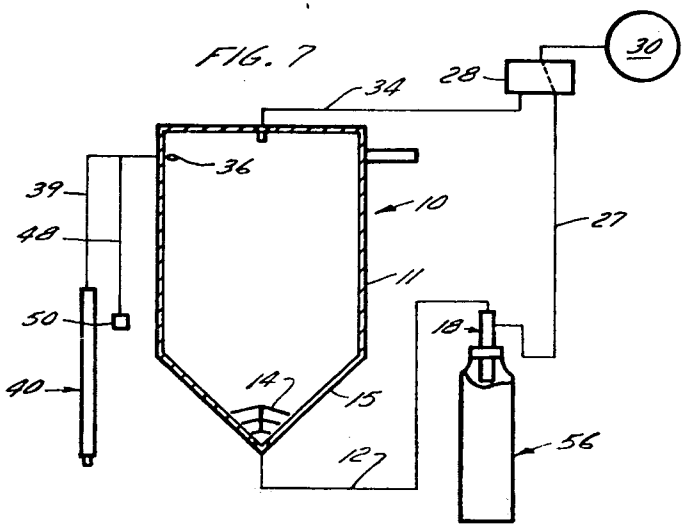
FIG. 7 is a schematic sectional view of the apparatus in use filling a fire extinguisher.

The filling of a fire extinguisher 56 is illustrated in FIG. 7 and will now be referred to. In this mode of operation, refill assembly 40 is left exposed to atmospheric air whereby the interior of reservoir 10 is subject to atmospheric pressure. Valve 28 is switched to connect vacuum source 30 with vacuum line 27. The extinguisher 56 has its top removed and sealing disc 26 is placed over the aperture.

The vacuum drawn through line 27 will lower the pressure within extinguisher 56 and the powder in reservoir 10, which is subject to atmospheric pressure, will flow through conduit 12 to extinguisher 56. Deflector or fluidizer 14 will impart a swirl pattern to the powder flow at the outlet thereby substantially eliminating any clogging or powder hand-up at this point. The powder flows through conduit 12 to extinguisher 56. In this respect, as previously discussed, nozzle 23 extends below the level of skirt 20 and thus the powder will tend to fall to the bottom of the extinguisher thereby minimizing the amount drawn through vacuum line 27.

Figure 8:
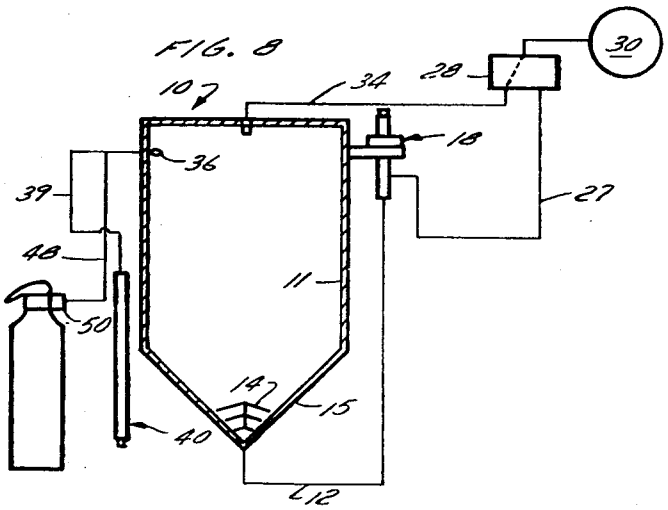
FIG. 8 is a schematic sectional view of the apparatus when discharging a previously charged extinguisher.
Figure 5:
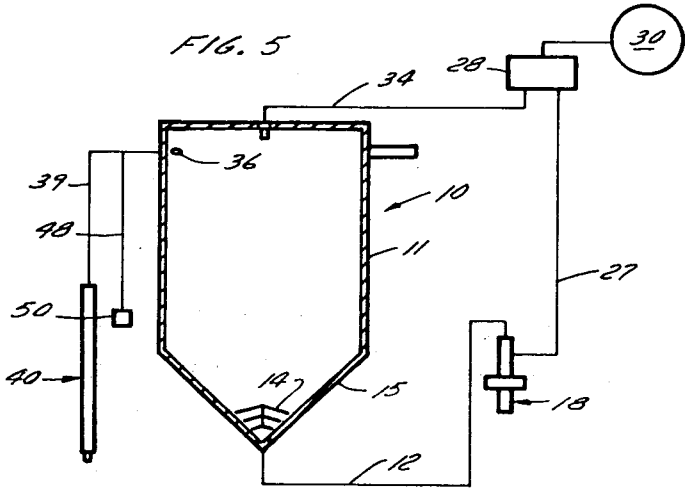
FIG. 5 is a schematic sectional view of the apparatus when idle.

Reference will now be made to FIG. 8 illustrating the operation of the apparatus and system for the discharge of a fire extinguisher 56. In this embodiment, assembly 40 is sealed and a vacuum, as was the case in FIG. 6, is drawn through conduit 34. The application of the vacuum to the reservoir 10 causes a reduction in pressure within reservoir 10. Adaptor 50 is then placed over the extinguisher and the same is discharged. The vacuum applied to the interior of reservoir 10 aids in the discharge thereof although, depending upon the pressurized extinguisher, the vacuum may not be necessary.

Figure 9:
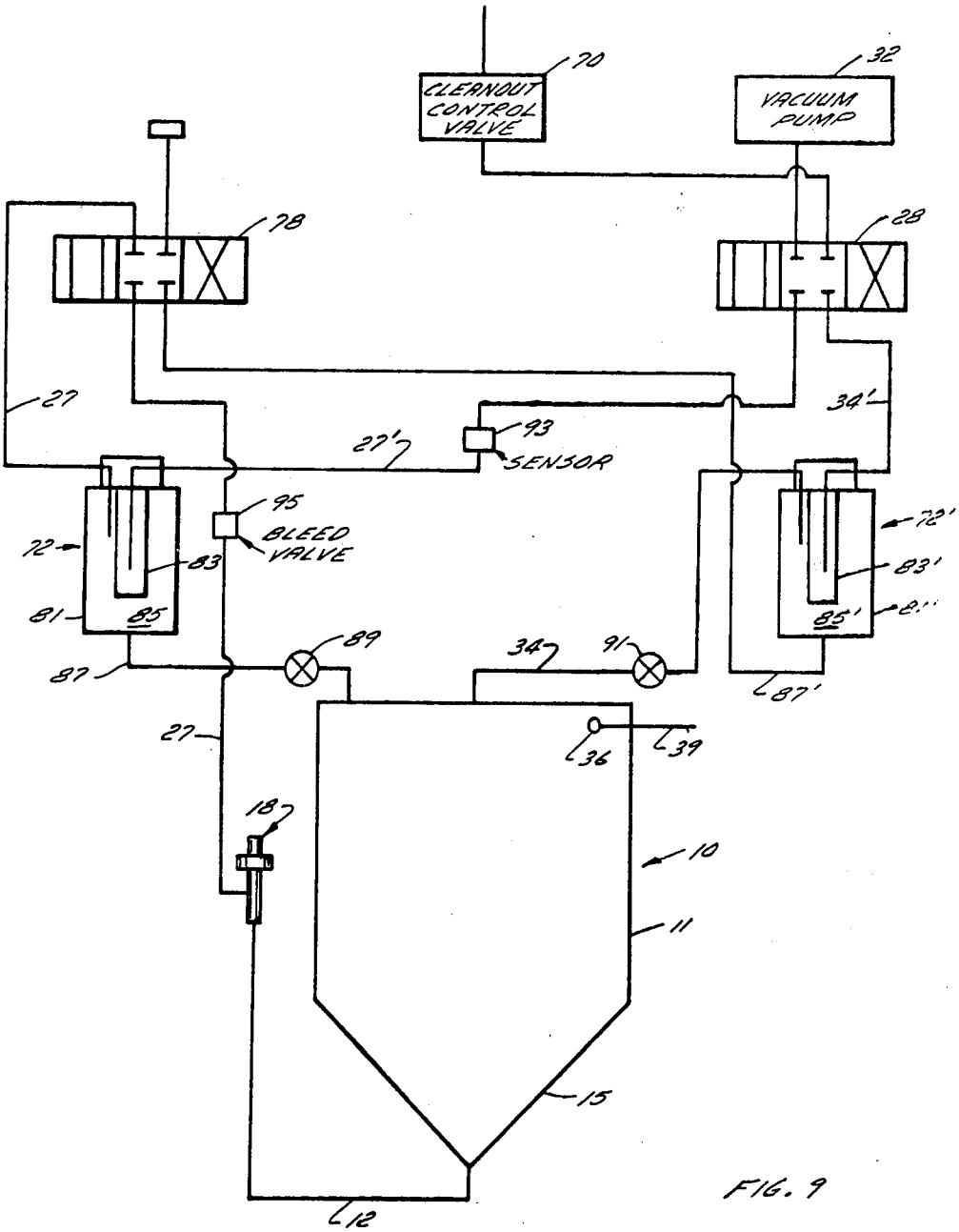
FIG. 9 is a schematic view of an apparatus and system including many optional features.

Referring to FIG. 9, there is illustrated a powder transfer apparatus and system, which system includes the use of many optional features such as filters and the like which were not shown, for the sake of clarity, in describing the operation of the apparatus of FIGS. 5 to 8. Similar reference numerals are employed as were employed in FIGS. 1 to 8.

Thus, in greater detail, the apparatus includes a reservoir 10 having an upper cylindrical portion 11 and a lower conical portion 15 with an outlet conduit 12 extending from the lowermost portion of conical section 15 to a filling assembly 18 substantially as was described with respect to FIG. 4. Extending from assembly 19 is vacuum line 27 which is connected to one side of a switching valve 78. Vacuum line 27 continues on the other side of switching valve 78 to a filter device generally designated by reference numeral 72. Filter device 72 not be of the "jar" type filter consisting of a container 81 having an interior filter 83 therein. Vacuum line 27 communicates with a cavity 95 between filter 83 and container 81—the vacuum line exits from the interior of filter 83 as designated by reference numeral 27'. Thus, any powder within vacuum line 27 is collected in container 81. In the preferred embodiment which is illustrated in FIG. 9, there is provided an outlet conduit 87 exiting from the bottom of container 81 and which is in communication with reservoir 10. A shut-off valve 89 is provided on this conduit 87.

From the interior of filter 83, vaccum line 27' is in communication with switching valve 28 on an outlet thereof, with vacuum pump 32 being on the inlet side.

The apparatus also includes a refill assembly (not shown) including inlet conduit 39.

A further vacuum line 34 is also in communication with the upper part of reservoir 10 as was discussed in the embodiment of FIGS. 1 to 8. As was the case with respect to vacuum line 27, a filter device is provided on conduit 34 and which filter device is of substantially identical construction to that above-described. Thus, filter device 72' includes an exterior container 81' ending in interior filter 83' thus forming a chamber 85' therebetween. Line 34 communicates with chamber 85' allowing any powder removed by the filter element 83' to settle to the bottom of container 81'. Clean air is then withdrawn through conduit 34' which is connected to switching valve 28. An outlet conduit 87' is provided for removal of powder from the bottom of filter element 72'—in the illustrated embodiment, line 87' is in communication with valve 78 and from there through to filter 72. Alternatively, line 87' could be in communication with reservoir 10. A shut-off valve 91 is provided on vacuum line 34.

In the embodiment illustrated, a clean-out control valve 70 may be provided permitting the flow of air through a conduit 93 which is connected to valve 28. This arrangement is employed when it is desired to clean out the filters.

In the illustrated embodiment of FIG. 9, a vacuum sensing device 93 may be provided on line 27 or 27' to sense the amount of vacuum drawn. Device 93 may be formed of several different structures well known to those skilled in the art and may be located in equivalent positions. Device 93 preferably includes a microswitch operative to shut off vacuum pump 32 when the vacuum in line 27 exceeds a certain predetermined value. In conjunction with this, line 27 may be provided with a bleed valve 95 permitting the introduction of atmospheric air into line 27 or 27' in controllable quantity to thereby adjust the value at which device 93 will shut off vacuum pump 32.

It will be understood that the above-described embodiments are for purposes of illustration and that changes and modifications may be made thereto without departing from the spirit and scope of the invention. Thus, the apparatus has been described specifically with respect to the use of powder for fire extinguishers. It will readily be understood that a substantially similar device may be employed for other fluids for other purposes if so desired.

I claim:

1. An apparatus suitable for selectively transferring a fluid comprising a reservoir adapted to contain the fluid to be transferred, an outlet conduit in fluid communication with a lower portion of the resevoir, a vacuum source, a filling assembly including a filling nozzle connected to the other end of said outlet conduit, means connecting said vacuum source and said filling assembly such that a vacuum applied thereto will cause fluid to flow from the reservoir through the outlet conduit to the filling nozzle, and conduit means connecting said vacuum source with an upper portion of said reservoir.

2. The apparatus of claim 1 wherein said filling assembly comprises said filling nozzle which is in fluid communication with said outlet conduit for dispensing a fluid therethrough, a skirt extending about said filling nozzle, said skirt terminating short of said nozzle and defining a cavity therebetween, said conduit means between said vacuum source and said filling assembly being in communication with said chamber.

3. The apparatus of claim 2 further including sealing means extending about said skirt, said sealing means being formed of a resilient material and being adapted to seat on the mouth of a container to which the fluid is to be transferred from said reservoir.

4. The apparatus of claim 1 further including means for refilling said reservoir from an external container, said means comprising an inlet situated in an upper side wall of said reservoir, an inlet conduit in fluid communication with said inlet, and a refill assembly at the other end of said inlet conduit.

5. The apparatus of claim 4 wherein said refill assembly includes a refill nozzle, a skirt extending about said refill nozzle thus forming a chamber between said nozzle and said skirt, said skirt having an least one aperture in an upper portion thereof providing fluid communication between said chamber and the atmosphere.

6. The apparatus of claim 3 wherein said filling nozzle is axially adjustable with respect to said skirt.

7. The apparatus of claim 4 further including sensing means on said means between said vacuum source and said filling assembly, and cut-off means asociated with said sensing means to cut off said vacuum source at a predetermined value.

8. The apparatus of claim 4 further including at least one filter means interposed in said conduit between said vacuum source and said filling assembly.

9. An apparatus suitable for selectively transferring powder, the apparatus comprising a reservoir, an outlet conduit having one end thereof in fluid communication with a lower end of said reservoir, a vacuum source, a filling assembly including a filling nozzle connected to the other end of said outlet conduit, conduit means extending between said vacuum source and said filling assembly such that when a vacuum is applied, a powder in said reservoir will flow to said outlet conduit to said filling nozzle, and vacuum sensing means situated in said conduit means, said vacuum sensing means being associated with means to shut off said vacuum source when the vacuum in said conduit means exceeds a predetermined value.

10. The apparatus of claim 9 wherein said reservoir has a bottom portion of an inverted conical configuration with said outlet conduit being in fluid communication with the bottom of said conical portion.

11. The apparatus of claim 10 further including fluidizing means situated at the bottom of said conical portion adjacent said outlet conduit.

12. A power transfer apparatus comprising a reservoir, an outlet conduit having one end thereof in fluid communication with a lower portion of said reservoir, a vacuum source, a filling assembly including a filling nozzle connected to the other end of said outlet conduit, conduit means extending between said vacuum source and said filling assembly and operative to cause a powder to flow through said outlet conduit when a vacuum is applied, refill means for refilling said reservoir from an external container, said refill means including an inlet situated in an upper portion of said reservoir, and filter means in said conduit means between said vacuum source and said filling assembly, said filter means including a discharge conduit extending from the filter to said reservoir such that any powder retained by said filter means may be selectively recycled back to said reservoir.

13. The apparatus of claim 12 further including second filter means in said conduit between said vacuum source and said refill means.

* * * * *